US005484301A

United States Patent [19]

Koumatsu et al.

[11] Patent Number: 5,484,301

[45] Date of Patent: Jan. 16, 1996

[54] INERTIA LOCKING-TYPE WATERPROOF CONNECTOR

[75] Inventors: Seiji Koumatsu; Kimihiro Abe, both of Shizuoka, Japan

[73] Assignee: Yazaki Corporation, Tokyo, Japan

[21] Appl. No.: 266,874

[22] Filed: Jul. 5, 1994

[30] Foreign Application Priority Data

Jul. 6, 1993 [JP] Japan ..... 5-166803

[51] Int. Cl.[6] ..... H01R 13/52

[52] U.S. Cl. ..... 439/271

[58] Field of Search ..... 439/271

[56] References Cited

U.S. PATENT DOCUMENTS 4,637,674 1/1987 Kobler ..... 439/271

FOREIGN PATENT DOCUMENTS 537751 4/1993 European Pat. Off. ..... 439/271
63-150479 10/1988 Japan .

*Primary Examiner*—Gary F. Paumen
*Attorney, Agent, or Firm*—Finnegan, Henderson, Farabow, Garrett & Dunner

[57] ABSTRACT

An inertia locking-type waterproof connector is provided in which male and female connectors having a waterproof packing interposed therebetween are fitted together by an inertia force produced when abutting a retaining projection of an elastic lock arm against an engagement portion for engaging the retaining projection. The inertia locking-type waterproof connector includes a female connector housing, a male connector housing for connection with the female connector housing, and an elastic lock arm provided on one of the male connector housing and the female connector housing and having a retaining projection. An engagement portion is provided on the other of the male connector housing and the female connector housing. The engagement portion engages with the retaining projection. A packing is interposed between the male connector housing and the female connector housing for providing a waterproof seal. The packing includes a seal lip in sliding contact with either the male connector housing or the female connector housing. The retaining projection, engagement portion, and packing are positioned so that, during insertion of the male connector housing into the female connector housing, the initial abutment of the retaining projection with the engagement portion coincides with the initial abutment of the seal lip with either the male connector housing or the female connector housing.

8 Claims, 5 Drawing Sheets

INERTIA LOCKING-TYPE WATERPROOF CONNECTOR

BACKGROUND OF THE INVENTION

1. Field of the Invention

This invention relates to an inertia locking-type waterproof connector in which male and female connectors remain fitted together even if a change in ambient temperature occurs.

2. Discussion of the Related Art

FIG. 7 shows a conventional inertia locking-type waterproof connector disclosed in Japanese Utility Model Unexamined Publication No. 63-150479.

This inertia locking-type waterproof connector 32 comprises a male connector 33 having an elastic lock arm 22' supported at both of its ends, a female connector 34 having an engagement frame portion 25 for engaging a retaining projection 23' of the lock arm 22', a waterproof packing 36 mounted on a bottom of a fitting chamber 35 of the female connector 34, and a packing holder 37 for retaining the packing 36.

A slanting abutment surface 26' of the retaining projection 23' is formed at an angle close to a vertical plane. The male and female connectors 33 and 34 are fitted together by the application of an inertia force pushing the slanting surface 26' against its mating engagement frame portion 25. The packing 36 has mountain-like seal lips 29 and 38 that are sequentially brought into intimate sliding contact with an outer wall surface 39 of the male connector 33 when the connectors are fitted together.

FIG. 8 shows the force required for fitting the connectors together. Dot-and-dash line T' represents the insertion force T' between male and female terminals (not shown) respectively located within the connectors 33 and 34. Dots-and-dash lines labeled $P_1'$, and $P_2'$ respectively represent sliding resistances $P_1'$ and $P_2'$ between the seal lips 29 and 38 and the male connector 33. The sliding resistance $P_2'$ of the seal lip 38 is larger than that of seal lip 29 because it is cumulative with the sliding resistance of the seal lip 29. The solid line has peaks labeled R' and S' that respectively represent an abutting force R' between the lock arm 22' and the engagement frame portion 25 and a combined force S' representing the sum of the insertion force T' between the terminals and the sliding resistance $P_2'$ between the male connector 33 and the packing 36. As shown, the abutting force R' of the lock arm 22' is larger than the combined force S' of the terminals and the packing 36. Thus, when the abutment between the retaining projection 23' and the engagement frame portion 25 is released, the mating terminals are inserted and the intimate sliding resistance between the packing 36 and the male connector 33 has been overcome.

In this conventional construction, however, problems occur when the lock arm 22', which is typically comprised of a synthetic resin, hardens or softens due to changes in ambient temperature. In accordance with this change, the abutting force, or inertia locking force, R' between the retaining projection 23' and the engagement frame portion 25 increases or decreases. If the inertia locking force increases, as shown by the dashed line with peak $R_1'$ in FIG. 8, the efficiency of the fitting operation is adversely affected as a very high force is required to disengage the connectors. If the inertia locking force is smaller than the combined force S' of the terminals and the packing 36, as shown by the dashed line with peak $R_2'$, then a tight fit between the connectors is not achieved.

SUMMARY OF THE INVENTION

The present invention has been made in view of the above circumstances and has as an object to provide an inertia locking-type waterproof connector in which even if a change in ambient temperature occurs, the efficiency of the connector fitting operation will not be adversely affected and a loose fit between the connectors will not occur.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the inertia locking-type waterproof connector of the present invention includes a female connector housing, a male connector housing for connection with the female connector housing, and an elastic lock arm provided on either the male connector housing or the female connector housing. The elastic lock arm includes a retaining projection. The inertia locking-type waterproof connector further includes an engagement portion provided on either the male connector housing or the female connector housing that the elastic lock arm is not provided on. The engagement portion engages with the retaining projection. A packing is interposed between the male connector housing and the female connector housing for providing a waterproof seal. The packing includes a seal lip in sliding contact with either the male connector housing or the female connector housing. The retaining projection, engagement portion, and packing are positioned so that, during insertion of the male connector housing into the female connector housing, the initial abutment of the retaining projection with the engagement portion coincides with the initial abutment of the seal lip with either the male connector housing or the female connector housing.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention. In the drawings, FIG. 1(*a*) is a cross-sectional view of one embodiment of an inertia locking-type waterproof connector according to the present invention showing a state just prior to connection of the male and female connectors;

FIG. 1(*c*) shows the engagement of the retaining projection of the lock arm with the engagement projection;

FIG. 6(*b*) shows engagement of the retaining projection with the engagement frame portion;

FIG. 6(*c*) shows the engagement of the male connector housing with the packing;

DESCRIPTION OF THE PREFERRED EMBODIMENTS OF THE INVENTION

The inertia locking-type waterproof connector according to the present invention includes a packing having a seal lip interposed between a male connector housing and a female connector housing. A retaining projection of an elastic lock arm is provided on either the male or female connector housing and is abutted against and engaged with an engagement portion provided on the other. The packing is held in intimate sliding contact with either the male or female connector housing. The positioning of the retaining projection, engagement portion, and packing is determined so that a load peak of the abutment between the retaining projection and the engagement portion can coincide with a load peak of the abutment between a front end of either the male or the female connector housing and the seal lip of the packing.

The abutting force of the connector housing against the packing is added to the abutting force of the projection of the lock arm against the engagement portion (the abutting force of the lock arm), thereby producing the total inertia locking force. As a change in ambient temperature affects the abutting force of the lock arm, if this force is set to a low level, a change in temperature will have a less severe effect on the total inertia locking force. An increase in temperature will cause only a slight increase in the inertia locking force.

Thereby, the connection of the male and female connectors can be accomplished more easily. At the same time, as the abutting force of the packing does not vary with temperature, a complete, tight, waterproof fitting is accomplished.

Figure 1A:
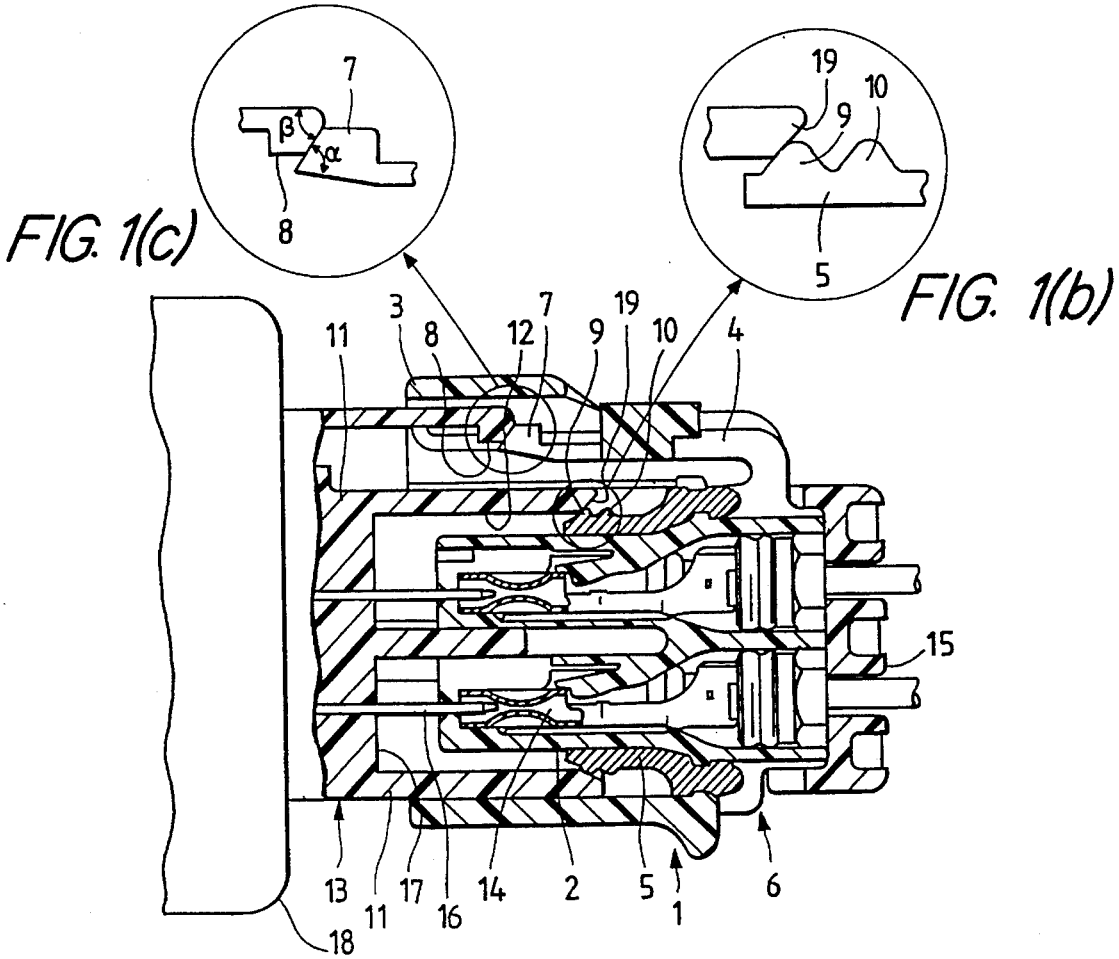
FIG. 1(*b*) shows the engagement of the packing with the front end of the female connector housing.
Figure 2:
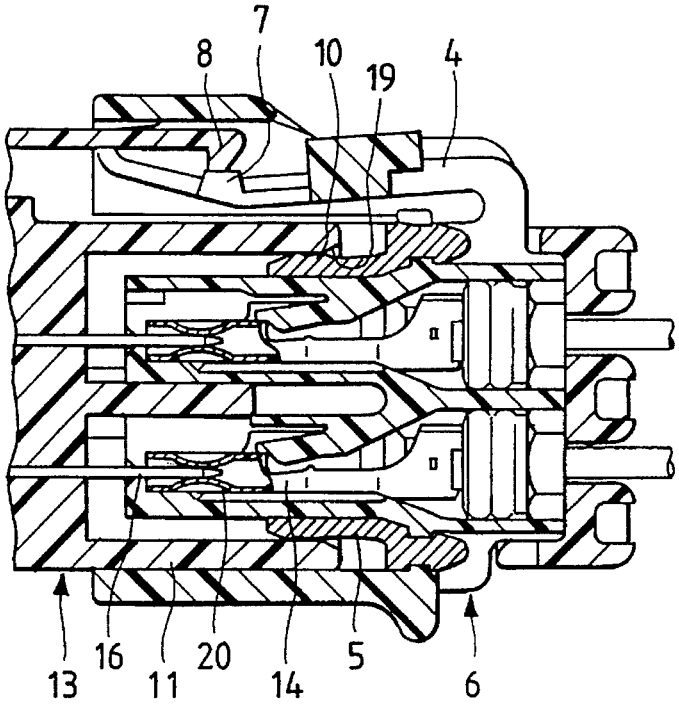
FIG. 2 is the same cross-sectional view of the waterproof connector shown in FIG. 1(*a*) showing a state during connection of the male and female connectors.
Figure 3:
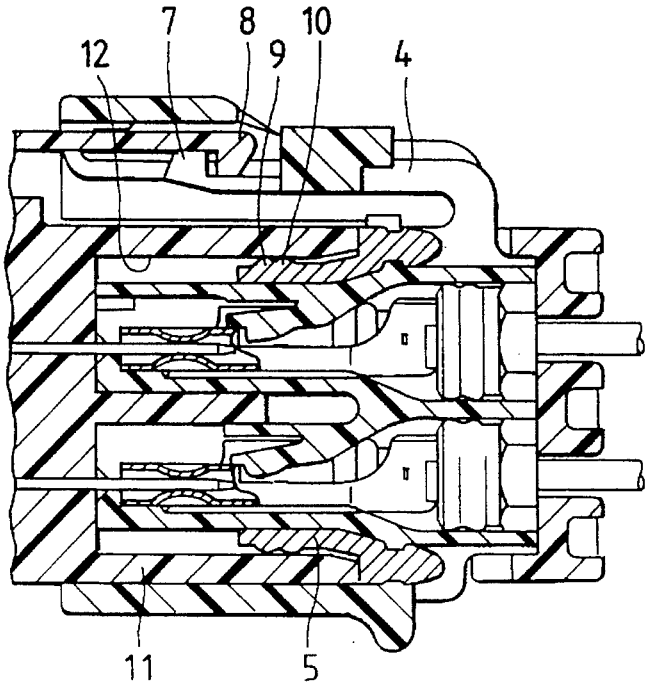
FIG. 3 is the same cross-sectional view of the waterproof connector shown in FIG. 1(*a*) showing a state after connection of the male and female connectors.
Figure 4:
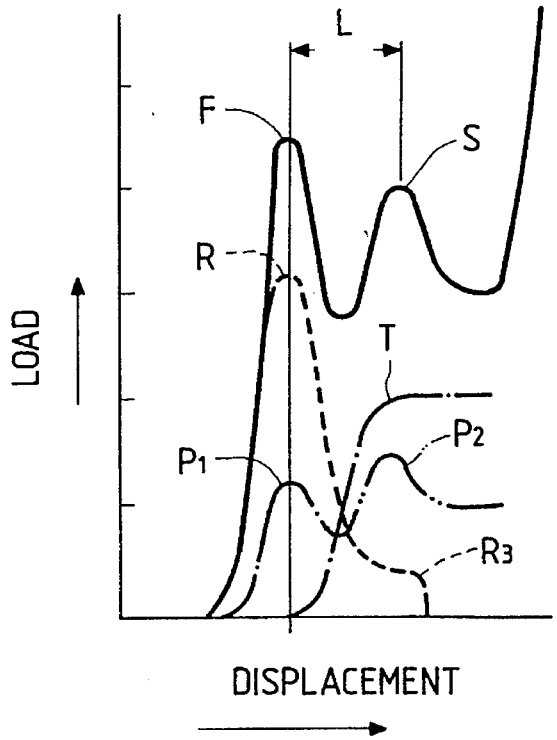
FIG. 4 is a load-displacement diagram showing the relation between a connector fitting load and a fitting stroke for an inertia locking-type waterproof connector according to the present invention.
Figure 5:
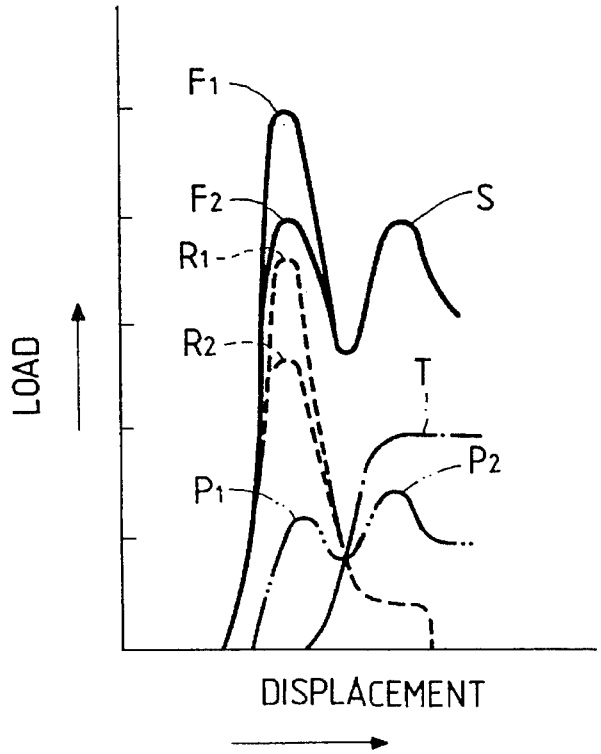
FIG. 5 is a load-displacement diagram showing variations in the inertia locking force due to an ambient temperature change for an inertia locking-type waterproof connector according to the present invention.

FIGS. 1 to 3 are cross-sectional views of an embodiment of an inertia locking-type waterproof connector of the present invention. The graphs in FIGS. 4 and 5 show the force required for fitting the portions of the connector together.

As shown in FIGS. 1(*a*), 1(*b*), and 1(*c*), the inertia locking-type waterproof connector 1 includes a male connector 6 having an elastic lock arm 4 supported at both of its ends. The lock arm 4 is within a hood portion 3 provided on an outer surface of a male connector housing 2. A waterproof packing 5 having mountain-like seal lips 9 and 10 is mounted on a proximal portion of the male connector housing 2.

The connector 1 further includes a female connector 13 which has a downwardly-directed engagement projection 8 for engaging an upwardly-directed retaining projection 7 of the lock arm 4. The female connector 13 also includes a female connector housing 11 with an inner wall surface 12 for sliding contact with the seal lips 9 and 10 of the packing 5.

A rear holder 15 retains female terminals 14 in the male connector 6. Male terminals 16 for connection with the female terminals 14 are projected from a wall 17 formed integrally with a unit 18.

Figure 8:
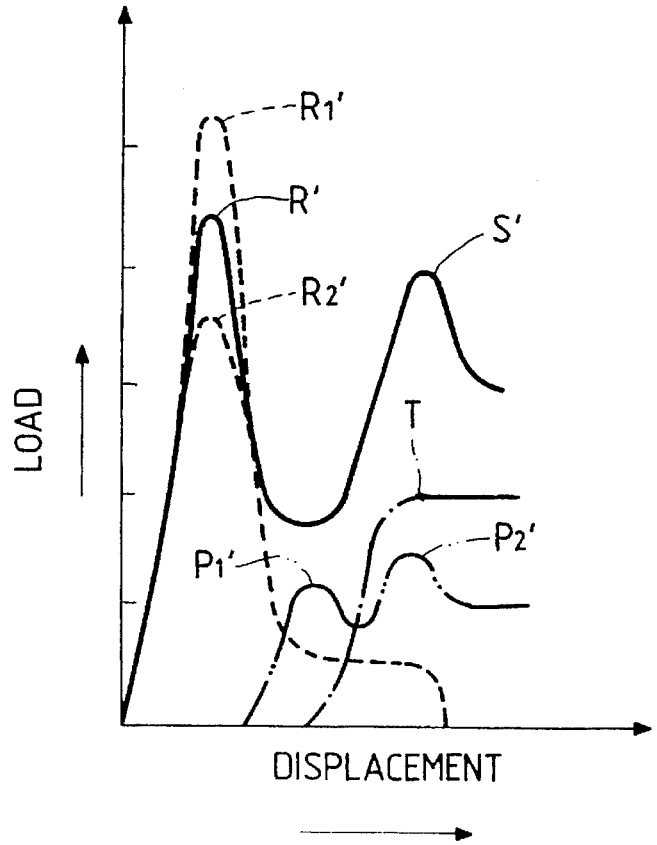
FIG. 8 is a load-displacement diagram showing the relation between a connector fitting load and a fitting stroke for the conventional waterproof connector shown in FIG. 7.

FIGS. 1(*a*), 1(*b*), and 1(*c*) the initial abutment and positioning of the retaining projection 7 with the engagement projection 8 and the first seal lip 9 of the packing 5 with the front end 19 of the female connector housing 11. The initial abutment of the retaining projection 7 against its mating engagement projection 8 occurs simultaneously with the abutment of the first seal lip 9 against the front end 19 of the housing 11, as shown in FIGS. 1(*a*) and 1(*c*). The angle of abutment of the retaining projection 7 against the engagement projection 8, as shown by the inclination angles $\alpha$ and $\beta$ of the projections 7 and 8, is relatively gentle. In other words, angles $\alpha$ and $\beta$ are not very large. Therefore, as shown by comparing FIG. 4 with FIG. 8, an abutting force R of the lock arm 4, representing the force of abutment of the retaining projection 7 against the engagement projection 8, is less than the conventionally-required force R'.

The amount of reduction of this abutting force, or the difference between R' and R, is compensated for by a force $P_1$ shown in FIG. 4. $P_1$ represents the force of abutment of the packing 5 against the female connector housing 11. This force $P_1$ is not influenced by changes in ambient temperature. The total inertia locking force F is the sum of the force R of the abutment between the retaining projection 7 and the engagement projection 8 and the force $P_1$ of the abutment between the first seal lip 9 and the front end 19 of the female connector housing 11.

FIG. 5 shows the change of the abutting force R between projections 7 and 8 due to a change in ambient temperature. The force R either increases to $R_1$ or decreases to $R_2$ depending on whether the temperature decreases or increases. The force $P_1$ of abutment between the packing 5 and the female connector housing 11 is added to the abutting force $R_1$ or $R_2$ to respectively comprise the total inertia locking force $F_1$ or $F_2$.

As a result of the addition of these forces, sufficient inertia locking force is obtained. Because the change of the abutting force R to $R_1$ or $R_2$ due to a change in temperature is small and because the abutting force $P_1$ between the packing 5 and the female connector housing 11 is not influenced by a temperature change, the variation of the total inertia locking force F to $F_1$ or $F_2$ due to a temperature change is smaller than the variations $R_1'$ and $R_2'$ of the conventionally-obtained inertia locking force R'.

The connection and fit between the male and female connectors 6 and 13 is initiated by the inertia locking force F as shown in FIG. 2. The elastic lock arm 4 is flexed downwardly while the retaining projection 7 slides past the engagement projection 8. At this time, the second seal lip 10 of the packing 5 contacts the front end portion 19 of the female connector housing 11 and slides against inner wall surface 12. Also, a contact spring piece 20 of each female terminal 14 is brought into sliding contact with the corresponding male tab terminal 16.

This condition is represented by a load peak S indicated on the solid line in FIG. 4. Load peak S represents the sum of forces $R_3$, T, and $P_2$. $R_3$ is the sliding resistance, as indicated by the broken line in FIG. 4, between the retaining projection 7 of the lock arm 4 and the engagement projection 8. T is the insertion force, represented by a dot-and-dash line, between the terminals 14 and 16, while $P_2$ is the sliding resistance, as shown by dots-and-dash line, between the packing 5 and the female connector housing 11. Since the point of application of the abutting force $P_1$ of the first seal lip 9 of the packing 5 coincides with the point of application of the abutting force R between the projection 7 of the lock arm 4 and the projection 8, the distance L between the point of application of the inertia locking force F and the point of application of the load peak S is smaller than in the conventional construction.

FIG. 5 shows the minimum value $F_2$ of the first load peak of the inertia locking force F occurring at a high temperature (after a rise in ambient temperature). $F_2$ is not smaller than the second load peak S because the abutting force $P_1$ of the first seal lip 9 is added to the abutting force $R_2$ of the lock arm 4. Similarly, the maximum value $F_1$ of the first load peak of the inertia locking force F occurring at a low temperature (after a decrease in ambient temperature) is shown in FIG. 5. Because the change in the value of the abutting force R to a value of $R_1$ due to the temperature change is small, the increase in the inertia locking force F to $F_1$ is small.

With the waterproof connector according to the present invention, the fitting between the male and female connectors is less influenced by a temperature change. A tight fit remains even if there is a temperature increase or decrease.

After the connectors are fitted together, the retaining projection 7 of the lock arm 4 is in locked engagement with the inner side of the engagement projection 8. Also, the seal lips 9 and 10 of the packing 5 are held in intimate contact with the inner wall surface 12 of the female connector housing 11. Through these contacts, a waterproof condition is provided.

Figures 6A, 6B, 6C:
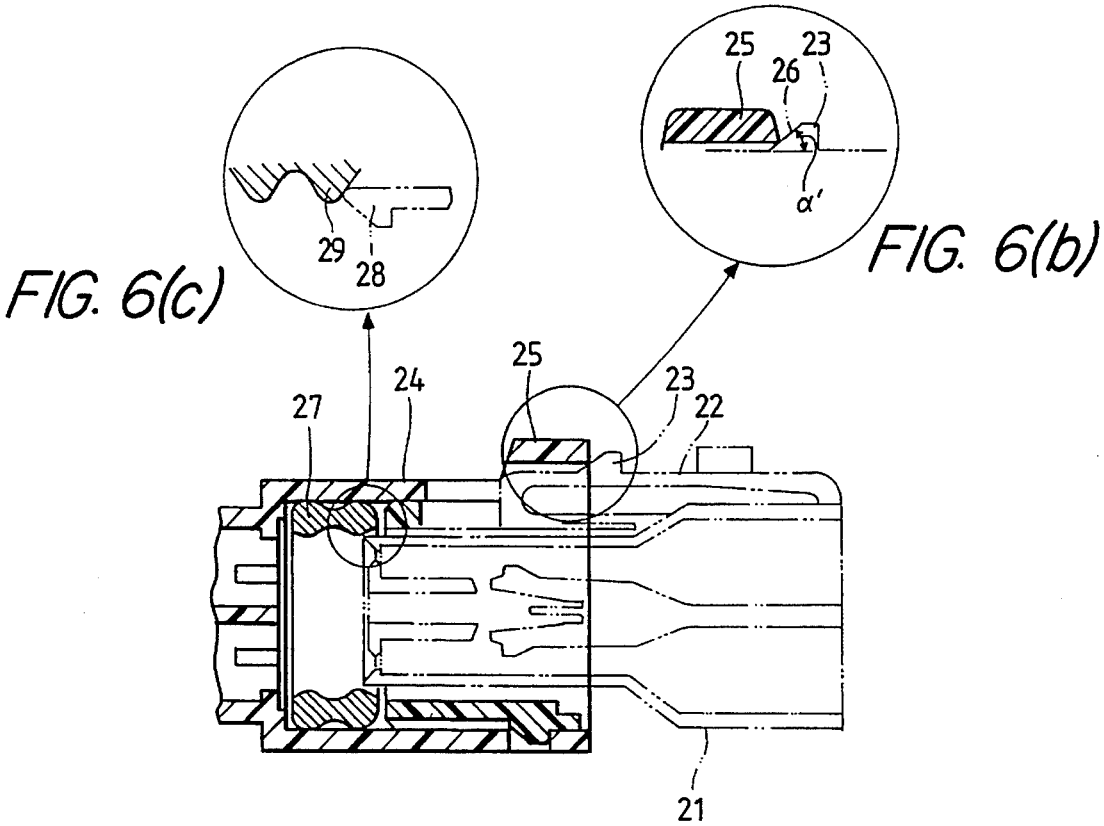
FIG. 6(*a*) is a cross-sectional view of another embodiment of an inertia locking-type waterproof connector according to the present invention.
Figure 7:
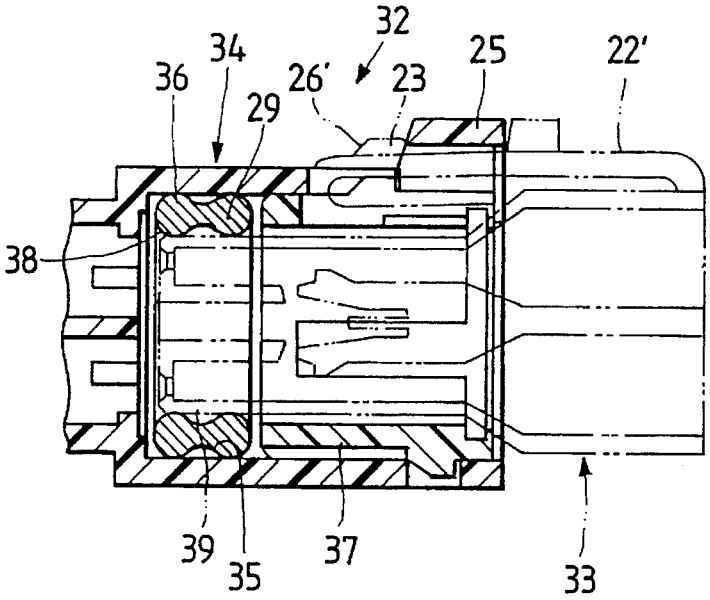
FIG. 7 PRIOR ART
FIG. 7 is a cross-sectional view of a conventional inertia locking-type waterproof connector.

FIGS. 6(*a*), 6(*b*), and 6(*c*) show another embodiment of the present invention. According to this embodiment, a retaining projection 23 is disposed more rearwardly on an elastic lock arm 22 of a male connector housing 21 than in the conventional construction shown in FIG. 7. The retaining projection 23 includes a slanting surface 26 that engages an engagement frame portion 25 of a female connector housing 24. The angle $\alpha'$ of the surface 26 is gentle (small) and determined by, among other things, the rigidity of the lock arm 22 and the abutment force of a packing 27 against a front end 28 of the male connector housing 21. As in the embodiment shown in FIG. 1(*a*), the abutment of the front end 28 against the packing 27 occurs simultaneously with the abutment of the retaining projection 23 against the engagement portion 25. The force of abutting the end 28 against a first seal lip 29 of the packing 27 adds to the abutting force of the projection 23 against the frame portion 25 to a produce a total inertia locking force.

It is to be understood that in each of the above embodiments, although the abutment of the front end of the connector housing against the first seal lip of the packing occurs simultaneously with the abutment of the retaining projection against the engagement portion, the initiation of the two abutments may differ from each other, so long as the load peaks of the abutting operations approximately coincide with each other.

As described above, the packing cooperates with the elastic lock arm to produce the inertia locking force. As the inertia locking force of the lock arm itself can be set to a low level, variations in this force due to a temperature change can be kept to a low level. Thereby, the stable fit and tight inertia locking between the male and female connectors is less influenced by a temperature change.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An inertia locking-type waterproof connector comprising:

a female connector housing;

a male connector housing for connection with the female connector housing;

an elastic lock arm provided on one of the male connector housing and the female connector housing, wherein the elastic lock arm includes a retaining projection;

an engagement portion provided on the other of the male connector housing and the female connector housing, said engagement portion for engaging with the retaining projection;

a packing interposed between the male connector housing and the female connector housing for providing a waterproof seal, said packing including a seal lip in sliding contact with either the male connector housing or the female connector housing; and wherein the retaining projection, engagement portion, and packing are positioned so that, during insertion of the male connector housing into the female connector housing, the initial abutment of the retaining projection with the engagement portion coincides with the initial abutment of the seal lip with either the male connector housing or the female connector housing.

2. The inertia locking-type waterproof connector according to claim 1, wherein the connector has a load peak for the abutment between the retaining projection and the engagement portion coinciding with the load peak of the abutment between the seal lip and either the male connector housing or the female connector housing.

3. The inertia locking-type waterproof connector according to claim 1, wherein the elastic lock arm is provided on the male connector housing and the engagement portion is provided on the female connector housing.

4. The inertia locking-type waterproof connector according to claim 1, further including:

male tab terminals within the female connector housing; and female tab terminals in the male connector housing for connection with the male connector terminals.

5. The inertia locking-type waterproof connector according to claim 4, wherein the packing includes first and second seal lips in sliding contact with the female connector housing.

6. The inertia locking-type waterproof connector according to claim 5, wherein during insertion of the male connector housing into the female connector housing, the connector has a load peak for the sum of the force of the abutment between the first seal lip and the female connector housing and the force of the abutment between the retaining projection and the engagement portion, said load peak being greater than or equal to the load peak of the sum of the sliding resistance between tile retaining projection and the engagement portion, the insertion force between the male tab terminals and the female tab terminals, and the sliding resistance between the seal lips and the female connector housing.

7. The inertia locking-type waterproof connector according to claim 5, wherein the sliding resistance between the seal lips and the female connector housing does not vary due to an ambient temperature change.

8. An inertia locking-type waterproof connector comprising:

a female connector housing;

a male connector housing for connection with the female connector housing;

an elastic lock arm provided on one of the male connector housing and the female connector housing, wherein the elastic lock arm includes a retaining projection;

an engagement portion provided on the other of the male connector housing and the female connector housing, the engagement portion for engaging the retaining projection;

a packing interposed between the male connector housing and the female connector housing for providing a waterproof seal, wherein the packing includes a seal lip in sliding contact with either the male connector housing or the female connector housing; and wherein the retaining projection, engagement portion, and packing are positioned so that, during insertion of the male connector housing into the female connector housing, the load peak of the abutment between the retaining projection and the engagement portion coincides with the load peak of the abutment between the seal lip and either the male connector housing or the female connector housing because the initial abutment of the retaining projection with the engagement portion coincides with the initial abutment of the seal lip with either the male connector housing or the female connector housing.

* * * * *